US006050812A

United States Patent [19]

Chuang

[11] Patent Number: 6,050,812

[45] Date of Patent: Apr. 18, 2000

[54] CANDLEHOLDER SET WITH MUSICAL FUNCTION

[76] Inventor: Tang Jung Chuang, No. 4, Alley 11, Lane 920, Min Hu Road, Hsinchu, Taiwan

[21] Appl. No.: 09/259,315

[22] Filed: Mar. 1, 1999

[51] Int. Cl.[7] ..... F23D 3/16

[52] U.S. Cl. ..... 431/253; 431/289

[58] Field of Search ..... 431/125, 253, 431/126, 289, 291, 288

[56] References Cited

U.S. PATENT DOCUMENTS 4,477,249 10/1984 Ruzek et al. ..... 431/253
5,015,175 5/1991 Lee ..... 431/253
5,807,096 9/1998 Shin et al. ..... 431/253
5,921,767 7/1999 Song ..... 431/253

FOREIGN PATENT DOCUMENTS 2171550 8/1986 United Kingdom ..... 431/288

*Primary Examiner*—Carl D. Price
*Attorney, Agent, or Firm*—Rosenberg, Klein & Lee

[57] ABSTRACT

The music playing in the conventional candleholder set with musical function is controlled by a switch installed on the candleholder. Therefore, the present invention provides an improvement for the candleholder set with musical function, wherein the music is induced by the candle light.

2 Claims, 4 Drawing Sheets

CANDLEHOLDER SET WITH MUSICAL FUNCTION

BACKGROUND OF THE INVENTION

The music playing in the conventional candleholder set with musical function is controlled by a switch installed on the candleholder. Therefore, the present invention provides an improvement for the candleholder set with musical function, wherein the music is induced by the candle light.

The presented candleholder set with musical function is composed of a candle, a socket, and a musical means. The candle is made of a transparent wax and a wick wrapped up by an opaque wax. The candle light may pass through the transparent wax to the musical means on the bottom of the candleholder to induce the music, and the music stops while the candle light is extinguished.

SUMMARY OF THE INVENTION

The object of the invention is to provide a candleholder set with musical function, which comprises a candle, a socket and a musical means, wherein the candle is a transparent wax and a wick wrapped up by an opaque wax; the socket including a transparent upper plate and a removable bottom plate to create a cabinet for installing a musical means in the center; the musical means is a box with a light transmitting window, which including a circuit board, a sensor underneath the light transmitting window, a cover and optionally a battery or related electrical parts.

BRIEF DESCRIPTION OF THE DRAWING

FIG. 3 is an elevation side view of the present invention while the flame is on.

DETAILED DESCRIPTION OF THE INVENTION

Figure 1:
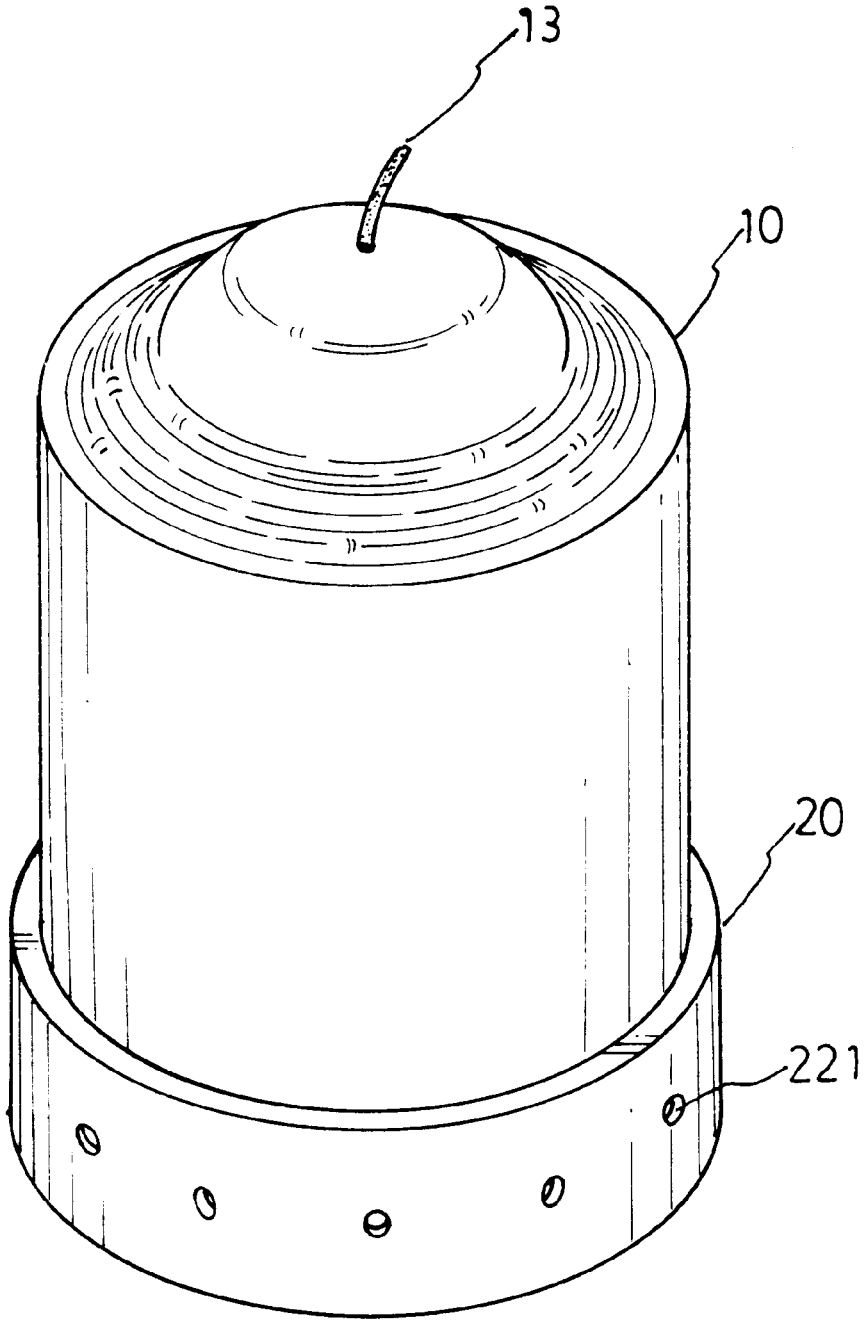
FIG. 1 is an elevation view of the present invention.
Figure 2:
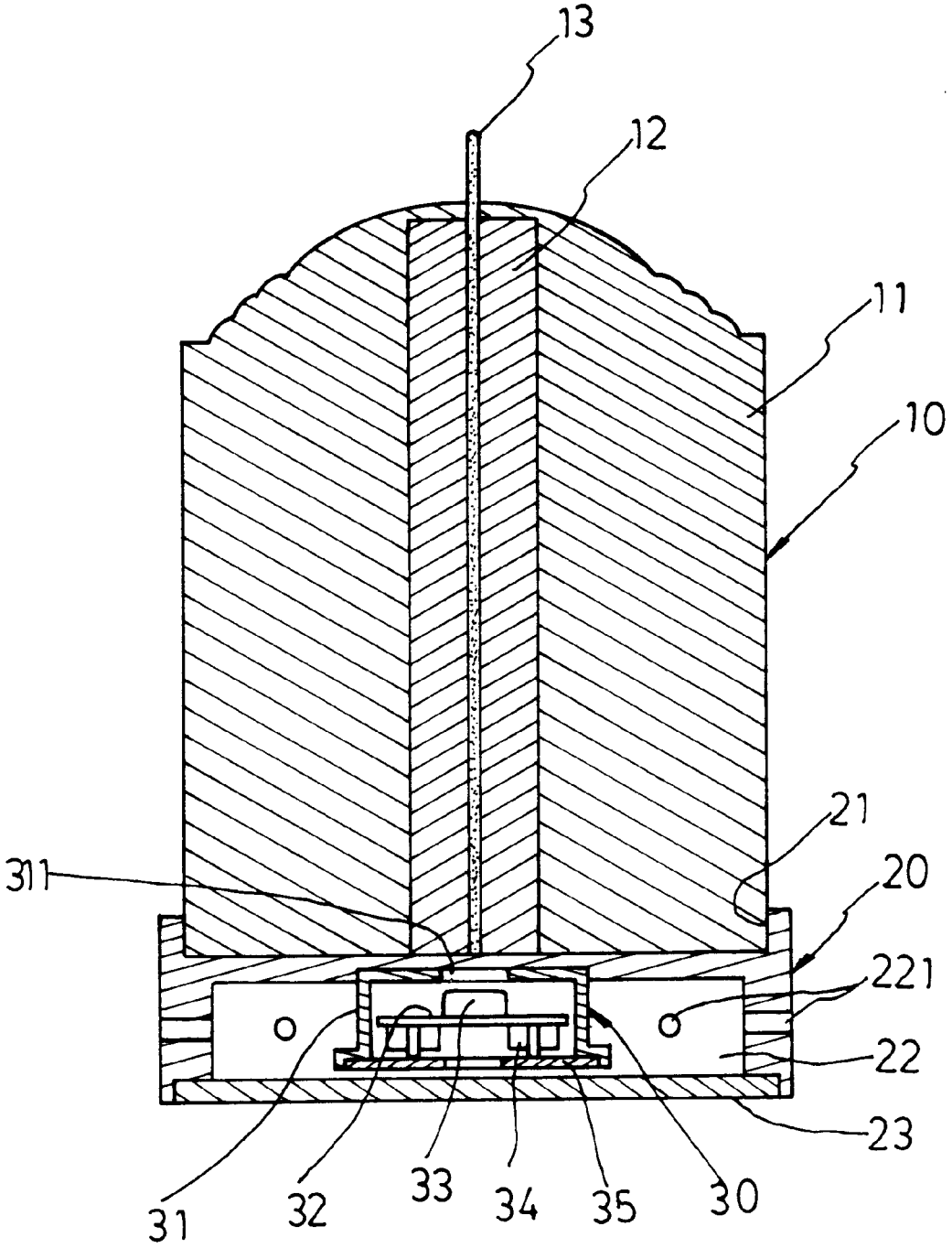
FIG. 2 is an elevation side view of the present invention.

Referring to FIG. 2, the candleholder set of the present invention comprises a candle (10), a socket (20) and a musical means (30). The top end (21) of the socket (20) may hold the candle (10), and its bottom end including a transparent upper plate and a removable bottom plate (23) to create a cabinet (22) for installing a musical means (30). Additionally, around the surface of the cabinet (22) may have several volume holes (221) or grille. The musical means (30) is a box (30) installed under the central of the cabinet (22) and has a light transmitting window (311) facing to the upper plate of the socket (20). The musical means (30) including a circuit board (32), a sensor (33), a cover (35) and optionally a battery (34) or related electrical parts. The sensor is installed between the circuit board (32) and the light transmitting window (311). The candle (10) consists of a transparent wax (12) and a wick (13) wrapped up by an opaque wax (11). When the candle (10) is installed on the top end (21) of the socket (20), the central part of the transparent wax (12) is just on the top of the light transmitting window (311).

Figure 3:
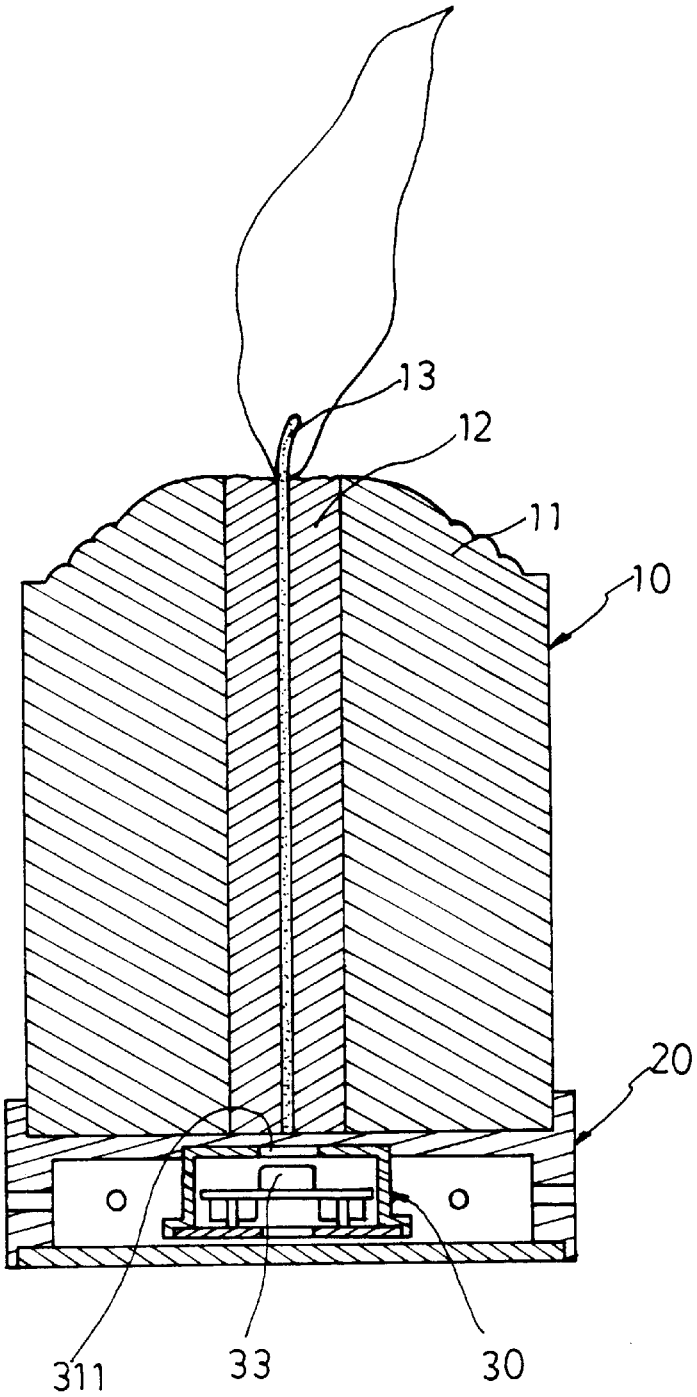
Figure 4:
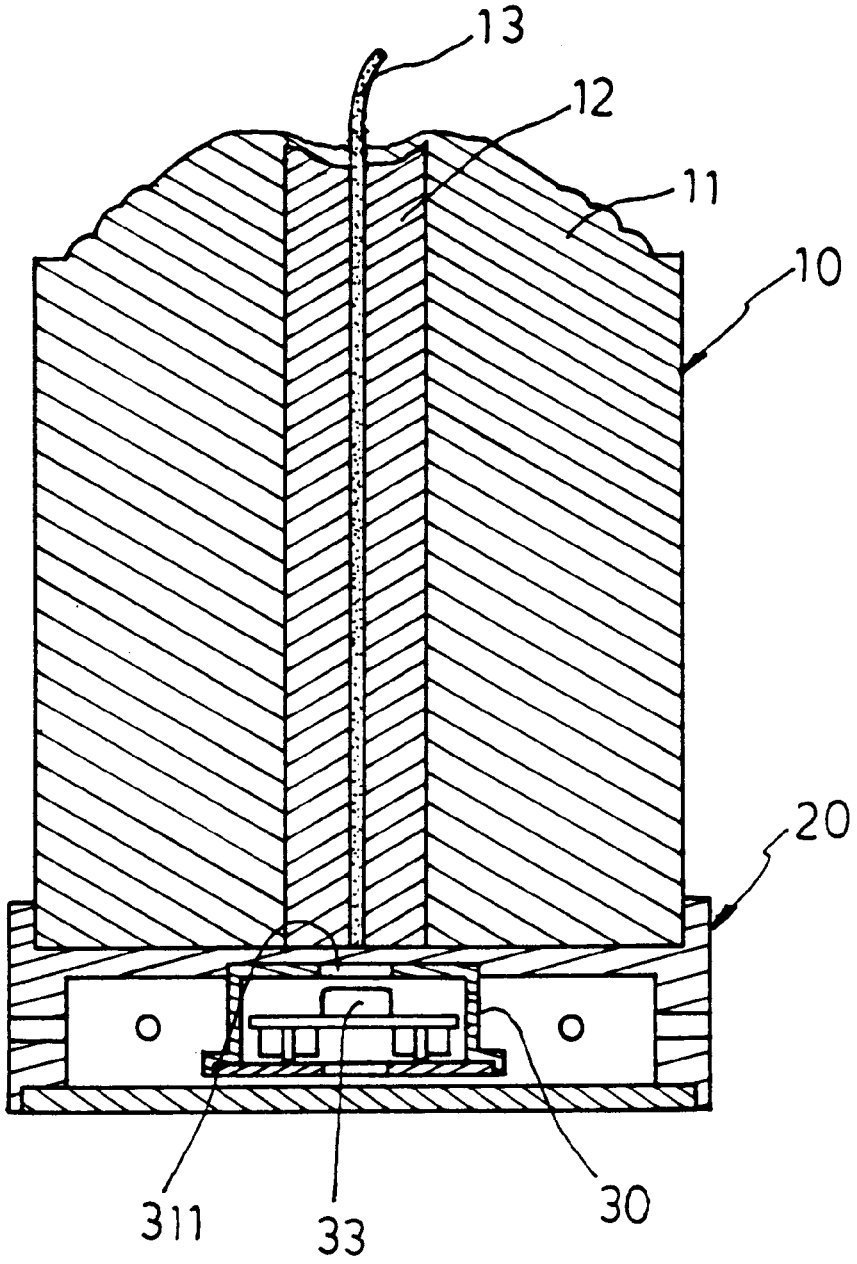
FIG. 4 is an elevation side view of the present invention while the flame is extinguished.

FIGS. 3 and 4 indicate the transmission manner of the candle light in the present invention. The opaque wax (11) on the candle tip is melted as a liquid form when the flame is on, and then possesses the light transmitting property. Accordingly, the candle light may pass through to the musical means (30) via the transparent wax (12) to induce the sensor (33) and play the music automatically. When the flame is extinguished, the molten opaque wax (11) flows to the lower level of the candle tip where it solidifies to block the light to the sensor and stop the music playing.

Although the present invention has been explained in relation to its preferred embodiment, it is to be understood that many other possible modifications and variations can be made without departing from the spirit and scope of the invention hereinafter claimed.

What is claimed is:

1. A candlelight assembly adapted for automatically generating sound comprising:

(a) a socket including a substantially transparent upper plate portion extending over a cabinet portion, said socket including a removable bottom plate portion for access to said cabinet portion;

(b) a candle coupled to said socket, said candle including: a first portion formed of a substantially transparent wax, a wick at least partially disposed in said first portion, and a second portion formed of a substantially opaque wax disposed about said first portion, said first portion engaging said upper plate portion of said socket; and, (c) means for automatically generating sound disposed in said cabinet portion of said socket, said means including a light sensor for actuating the sound generation responsive to flame ignition of said wick, said sensor being disposed adjacent said upper plate portion of said socket in optical communication with said first portion of said candle.

2. The candlelight assembly as recited in claim 1 wherein said means for automatically generating sound includes:

(a) a housing having a light transmitting window formed thereon for optical access to said sensor therethrough;

(b) a sound generating circuit board disposed within said housing; and, (c) a power source for energizing said sound generating circuit board.

* * * * *